US006670931B2

(12) United States Patent
O'Connell

(10) Patent No.: US 6,670,931 B2
(45) Date of Patent: Dec. 30, 2003

(54) ANTENNA HAVING CROSS POLARIZATION IMPROVEMENT USING ROTATED ANTENNA ELEMENTS

(75) Inventor: John Byam O'Connell, Seattle, WA (US)

(73) Assignee: The Boeing Company, Chicago, IL (US)

( * ) Notice: Subject to any disclaimer, the term of this patent is extended or adjusted under 35 U.S.C. 154(b) by 21 days.

(21) Appl. No.: 09/992,976

(22) Filed: Nov. 19, 2001

(65) Prior Publication Data

US 2003/0095070 A1 May 22, 2003

(51) Int. Cl.[7] ..... H01Q 1/38
(52) U.S. Cl. ..... 343/893; 343/700 MS
(58) Field of Search ..... 343/893, 700 MS, 343/829, 846, 824, 826, 827, 848

(56) References Cited

U.S. PATENT DOCUMENTS 5,136,304 A 8/1992 Peters ..... 343/777
5,160,936 A 11/1992 Braun et al. ..... 343/725
5,276,455 A 1/1994 Fitzsimmons et al. ..... 343/777
6,005,512 A 12/1999 Wong ..... 342/80
6,020,848 A 2/2000 Wallace et al. ..... 342/362
6,205,224 B1 3/2001 Underbrink ..... 381/92
6,225,950 B1 * 5/2001 Johansson et al. ... 343/700 MS
6,351,247 B1 2/2002 Linstrom et al. ..... 343/797

OTHER PUBLICATIONS

WO 97/38465.

* cited by examiner

*Primary Examiner*—James Clinger
(74) *Attorney, Agent, or Firm*—Harness Dickey & Pierce P.L.C.

(57) ABSTRACT

A phased array antenna having a plurality of independent antenna modules which are arranged in a manner to significantly improve cross polarization isolation of the antenna. The antenna modules are arranged in rows and columns to form a grid arrangement. Each antenna module has a pair of radiating elements, and each module is rotated 90° from its adjacent antenna modules in each column. In this manner, the worst case cross polarization isolation performance of each module is not summed together at the same azimuth scan angle as every other module but rather is broken up over the entire azimuth scan angle.

10 Claims, 3 Drawing Sheets

ANTENNA HAVING CROSS POLARIZATION IMPROVEMENT USING ROTATED ANTENNA ELEMENTS

FIELD OF THE INVENTION

The present invention relates to electronically steered antennas, and more particularly to an electronically steered, phased array antenna having a plurality of independent antenna modules, wherein each of the antenna modules are rotated relative to an adjacent module by a predetermined number of degrees to significantly improve cross polarization isolation of the antenna.

BACKGROUND OF THE INVENTION

An electronically steered, phased array antenna uses a large quantity of independent antenna modules laid out in a flat grid pattern. Each of these modules has a pair of conductive elements "A" opposed by 90° to each other. A highly simplified illustration of one such antenna module is shown in FIG. 1. Specific details of the construction of such antennas are disclosed in U.S. Pat. No. 5,276,455 to Fitzsimmons et al., issued Jan. 4, 1994 and hereby incorporated by reference into the present application. In a perfect antenna, these conductive elements would be isolated from each other. Since they are not, a portion of the signal intended for one of these conductive elements ends up being received (or transmitted) by the other element. When all of the module element signals are summed together, the desired signal can end up being corrupted by the non-isolated signal. An increase in the amount of corruption causes a decrease, or deteriorization, in cross polarization isolation.

The preferred solution to improving cross polarization isolation in the summed element antenna pattern is to design and build a module with perfectly isolated elements. This is often impossible and/or expensive. A second proposed solution is to isolate the summed signal from one polarization, phase shift it and subtract a certain amount of it from the summed signal of the other polarization. The practical implementation of this approach, however, has not been achievable to date.

A typical electronically steered antenna has a thin layer of low dielectric material adhered to the top of the antenna aperture. Its purpose is to improve the impedance match at the input of each antenna module over the scan angle. This layer is called the wide angle impedance match (i.e., WAIM). The expected cross polarization isolation of an antenna with a WAIM is shown in FIG. 2. This expected cross polarization isolation example is taken from an antenna with a module grid pattern as shown in FIG. 3. The WAIM is only able to maximize the cross polarization isolation at a particular module spacing, in this case at 30°, 90°, 150°, 210°, 270° and 330° azimuth scan angles, which corresponds to the shortest distance possible between adjacent modules. With perfectly isolated elements within each module, the overall cross polarization isolation should look like that provided in FIG. 2, with high numbers (best case cross polarization isolation) at azimuth scan angles of 30°, 90°, 150°, 210°, 270° and 330° and lower numbers (worst case cross polarization isolation) at azimuth scan angles of 0°, 60°, 120°, 180°, 240° and 300°. It will be appreciated that the −30° line in FIG. 3 is equal to 330° in FIG. 2. It will also be appreciated that the WAIM improves the overall cross polarization isolation.

With imperfectly isolated elements within each module, the cross polarization isolation appears as presented in FIG. 4. Referring to FIG. 4, the cross polarization isolation pattern no longer repeats every 60° corresponding to the distance between modules at a given azimuth angle, but is now resolved into a pattern where the best case cross polarization isolation is about equal to the expected worst case cross polarization isolation. Looking at azimuth scan angle 0°–90°, the best cross polarization isolation lies between 0° and 60° and falls off to the worst case cross polarization isolation at 90° (13 dB). The pattern that improves and worsens until the second worst case cross polarization isolation occurs at approximately 170° of azimuth scan angle (15.2 dB). This pattern then repeats from 180° to 360°.

To explain the change from a pattern that varies every 60° to one that is considerably worse and varies roughly every 180°, it is instructive to look at the element orientation within the antenna. Currently, all of the module elements used in present day phased array antennas are typically aligned with one another as shown in FIG. 5. A simulation of this orientation in an array of 1528 modules has been done by The Boeing Co. and cross polarization isolation was determined for four azimuth scan angles (0°, 30°, 60° and 90°) at an elevation scan angle of 60°. This information is presented in Table 1 below:

TABLE I

| Azimuth Scan Angle | Cross Polarization Isolation |
|---|---|
| 0 degrees | 18 dB |
| 30 degrees | 16.5 dB |
| 60 degrees | 17.8 dB |
| 90 degrees | 12.4 dB |

These four data points of Table 1 compare favorably with the measured data as shown in FIG. 4, thus verifying the simulation approach.

Simulation of an individual module shows that the amount of energy reflected (i.e., return loss) off of each radiating element when compared to its neighboring element also demonstrates a 180° pattern. This implies that the total summation of individual module element outputs is masking the expected cross polarization isolation pattern. This simulation is illustrated in Table II below.

TABLE 2

| Azimuth Scan Angle | Element 1 Return Loss | Element 2 Return Loss | Delta |
|---|---|---|---|
| 0 degrees | −13 dB | −12 dB | 1 dB |
| 30 degrees | −14 dB | −11 dB | 3 dB |
| 60 degrees | −18 dB | −10 dB | 8 dB |
| 90 degrees | −25 dB | −9 dB | 16 dB |
| 120 degrees | −18 dB | −10 dB | 8 dB |
| 150 degrees | −14 dB | −11 dB | 3 dB |
| 180 degrees | −13 dB | −12 dB | 1 dB |

Accordingly, it is a principal object of the present invention to provide an electronically scanned, phased array antenna which provides significantly improved cross polarization isolation over prior developed phased array antennas. More particularly, it is an object to provide a phased array antenna having a plurality of antenna modules which are arranged in such a pattern that the overall cross polarization isolation of the antenna is significantly improved.

SUMMARY OF THE INVENTION

The above and other objects are provided by an electronically scanned, phased array antenna in accordance with a preferred embodiment of the present invention. The antenna of the present invention includes a plurality of independent antenna modules which are spaced in a grid arrangement. Each antenna module has a pair of radiating elements which are offset relative to each other by a predetermined angle. In one preferred form, this angle comprises 90°. The antenna modules are arranged such that they form a plurality of columns and rows. Each column has adjacent antenna modules rotated by approximately 90° from one another. Accordingly, no two adjacent antenna modules in each column are aligned in identical orientations.

In one preferred form, the antenna modules in each column are rotated such that the modules are arranged in a repeating pattern of 0°, 90°, 180° and 270°. In this manner, the worst case cross polarization isolation performance of each module is not summed together at the same angle as every other module, but rather is broken up over the entire azimuth scan angle.

The phased array antenna of the present invention thus does not require significant manufacturing modifications nor any added expense to improve the cross polarization isolation of the antenna. By simply rotating adjacent antenna modules disposed in each column of the grid of modules, the present invention avoids the problem of summing the worst case cross polarization isolation performance of each module at a given azimuth scan angle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 6:
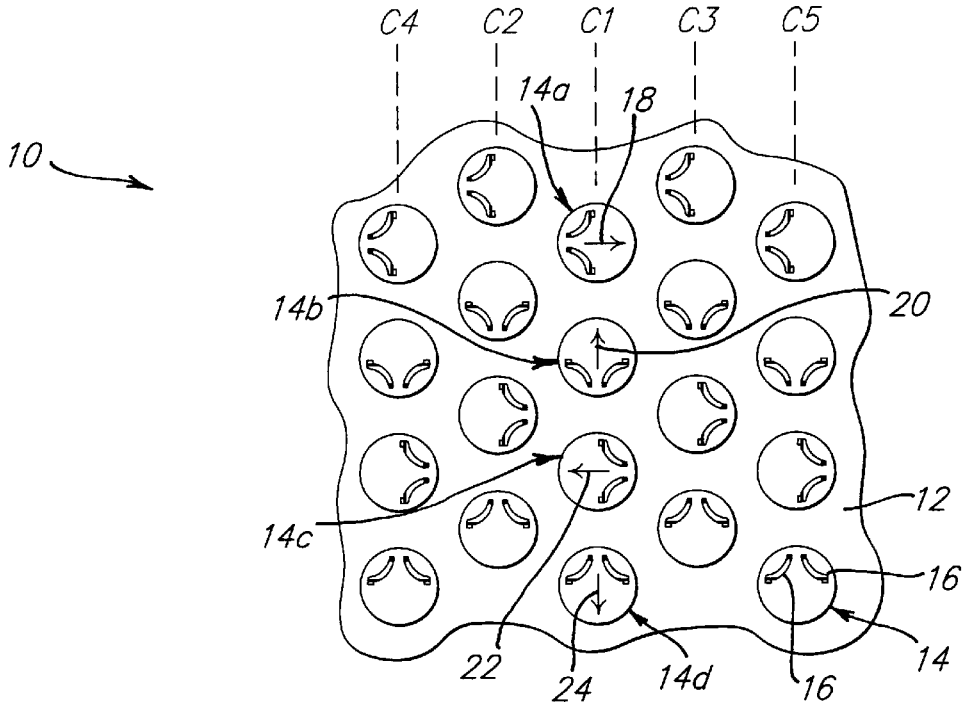
FIG. 6 is an illustration of an electronically scanned, phased array antenna of the present invention wherein the independent antenna modules are rotated such that adjacent modules in each column of the grid of modules are rotated 90° from each other.

Referring to FIG. 6, a highly simplified view of an electronically scanned, phased array antenna in accordance with a preferred embodiment of the present invention is shown. The antenna 10 comprises a wide angle impedance matching (WAIM) layer 12 within which are disposed a plurality of independent , identical antenna modules 14. The modules 14 are arranged in rows and columns forming a grid arrangement. The antenna modules 14 are disposed closely adjacent one another and each module includes a pair of radiating elements 16. Radiating elements 16 of each module 14 are arranged at an angle of about 90° relative to each other.

It will be appreciated immediately that, in actual practice, the antenna 10 will incorporate a large plurality of antenna modules 14, and typically on the order of several hundred to several thousand such modules 14.

Figure 1:
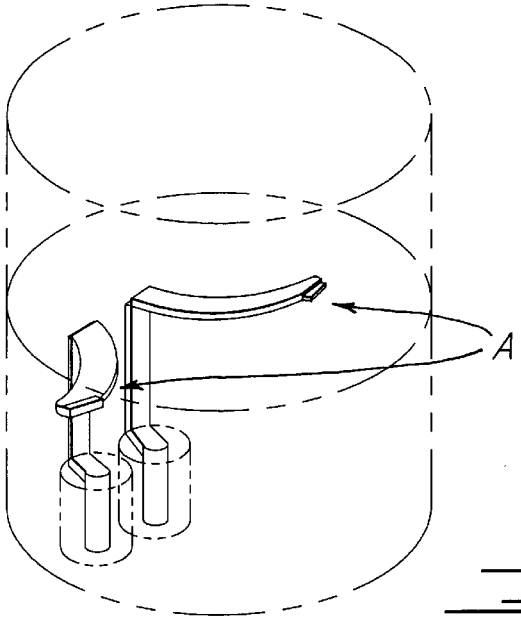
Prior Art FIG. 1.
FIG. 1 is a highly simplified view of one prior art antenna module illustrating the conductive elements being arranged at an angle of 90° relative to each other.

With further reference to FIG. 1, it will be noted that each module 14 in each column is rotated 90° relative to both of its adjacent modules. For example, in column C1, module 14*b* is orientated such that its radiating elements 16 are rotated 90° from the radiating elements 16 of module 14*a*. This is illustrated by arrows 18 and 20. Antenna module 14*c* is similarly rotated 90° from element 14*b*, as indicated by arrow 22. Element 14*d* is rotated 90° from element 14*c*, as indicated by arrow 24. The antenna modules 14 in each of rows C2–C5 are similarly rotated such that each module in each column is rotated 90° from both of its immediately adjacent modules.

The above described pattern of arranging the antenna modules 14 has the effect of preventing the worst case cross polarization isolation performance of each module from being summed together at the same angle as every other module. Instead, the worst case performance of each module 14 is broken up over the entire azimuth scan angle. A simulation of an array of 1528 antenna modules 14 rotated as shown in FIG. 6 was performed for four azimuth scan angles 0°, 30°, 60° and 90° at an elevation scan angle of 60°. The cross polarization isolation is illustrated in Table 3 below.

TABLE 3

| Azimuth Scan | cross pol isolation |
|---|---|
| 0 degrees | 35 dB |
| 30 degrees | 21 dB |
| 60 degrees | 37 dB |
| 90 degrees | 20 dB |

Figure 2:
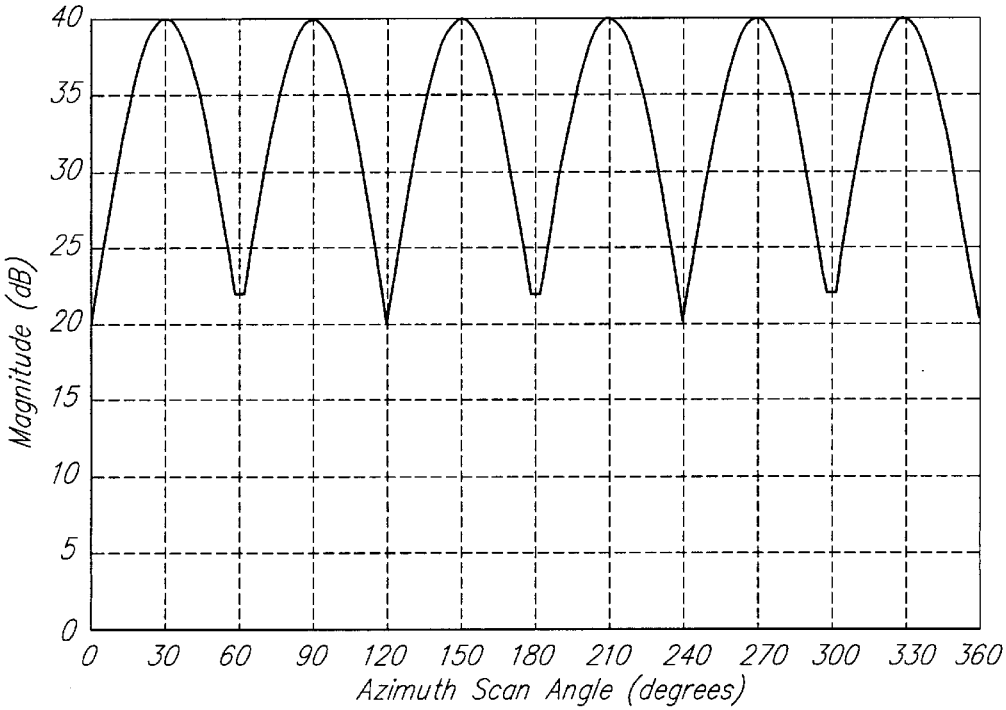
FIG. 2 is a graph illustrating an expected cross polarization isolation of an antenna having a module grid pattern as shown in FIG. 3.
Figure 3:
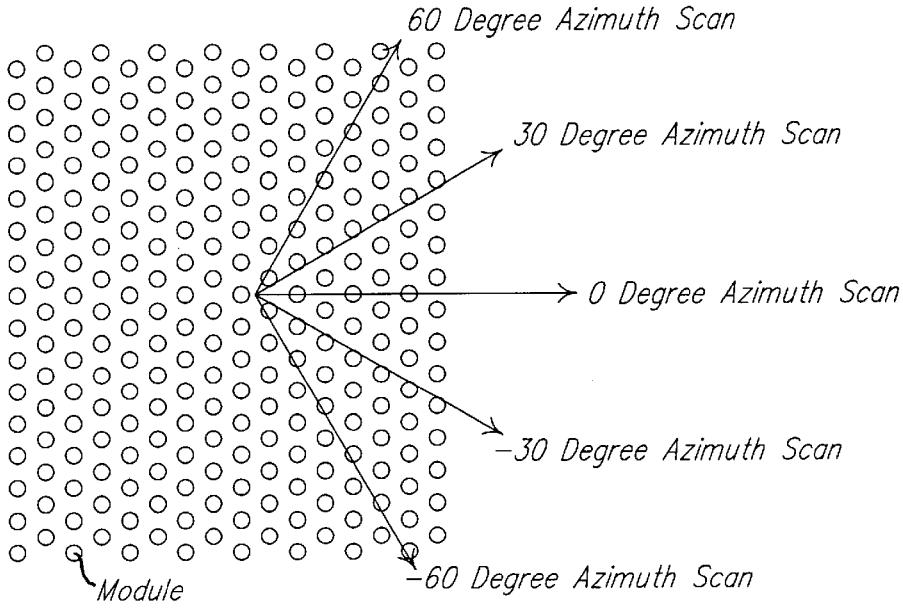
Prior Art FIG. 3.
FIG. 3 is a view of a prior art antenna module grid of a phased array antenna showing the maximized and minimized azimuth scan angles.
Figure 4:
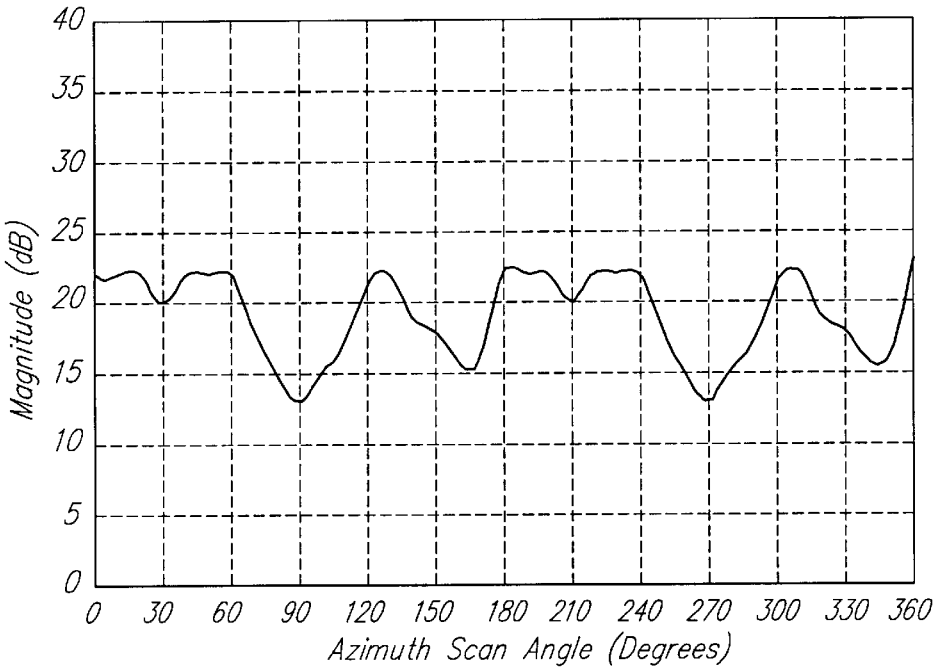
FIG. 4 is a graph illustrating a cross polarization isolation with imperfectly isolated antenna module elements, at an elevation scan angle of 60°.
Figure 5:
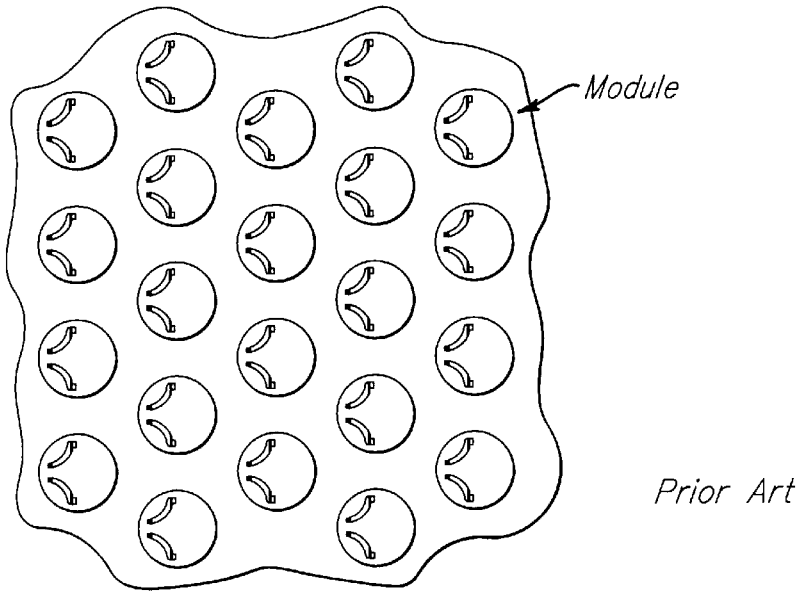
FIG. 5 is a simplified view of a prior art grid of antenna modules of a phased array antenna illustrating the uniform arrangement of the radiating elements of each module relative to one another.

From Table 3 it can be seen that the cross polarization isolation has been dramatically improved at each azimuth scan angle. It can also be seen that the overall cross polarization isolation has returned to the expected pattern of FIG. 2, wherein the best cross polarization isolation occurs at 0° and 60° azimuth scan angles and the worst cross polarization occurs at 30° and 90° azimuth scan angles.

The antenna 10 of the present invention thus provides a means for dramatically improving the cross polarization isolation of an electronically scanned, phased array antenna. Advantageously, the benefits of the present invention are provided without significantly adding to the overall cost of a phased array antenna or otherwise significantly complicating its construction or requiring additional component elements to be introduced into the construction of the antenna. By simply rotating each of the antenna modules 14 of the antenna 10 in the pattern herein described, the cross polarization isolation is significantly improved.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A phased array antenna system operable to provide improved cross polarization isolation, said system comprising:

a plurality of antenna modules arranged in a plane and disposed adjacent one another;

each of said antenna modules having a pair of electrically conductive radiating elements;

each of said antenna modules being arranged such that any given antenna module has at least one antenna module adjacent thereto which is rotated such that said radiating elements of said adjacent antenna module do not extend along an axis which is parallel to an axis along which said radiating elements of said given antenna module extend; and wherein said adjacent antenna module is rotated 90° relative to said given antenna module.

2. The antenna system of claim 1, wherein said given antenna module has at least a pair of adjacent antenna modules which are rotated such that no one of said given antenna module and said pair of adjacent antenna modules adjacent to said given antenna module are arranged such that said radiating elements of each of said antenna modules extend along a common axis.

3. The antenna system of claim 2, wherein said given antenna module and said pair of adjacent antenna modules are arranged along a longitudinal line; and wherein each of said adjacent antenna modules are rotated 90° relative to said given antenna module.

4. A phased array antenna system operable to provide improved cross polarization isolation, comprising:

a plurality of antenna modules arranged in a plurality of rows and columns to form a grid, each of said antenna modules including a pair of electrically conductive elements;

wherein adjacent pairs of said antenna modules in at least one of said columns are arranged such that said conductive elements of each are rotated 90° relative to one another; and wherein a given antenna module of said adjacent Pairs of antenna modules is bordered by ones of said antenna modules in at least one adjacent row of said antenna modules, such that said elements of said ones of said antenna modules in said adjacent row are rotated 90° from said elements of said given antenna module.

5. The system of claim 4, wherein said antenna modules in each of said columns are arranged such that adjacent pairs of said antenna modules have their respective said conductive elements rotated 90° relative to one another.

6. The system of claim 4, wherein one said column includes three said antenna modules; and wherein a second one of said three antenna modules is arranged such that its said conductive elements are rotated 90° relative to conductive elements of a first one of said antenna modules; and wherein a third one of said three antenna modules is arranged such that its said conductive elements are rotated 90° relative to conductive elements of said second one of said three antenna modules.

7. The antenna system of claim 4, wherein said antenna system produces a maximum cross polarization isolation at azimuth scan angles of 0° and 60° relative to a boresight of said antenna system.

8. A phased array antenna system for providing improved cross polarization isolation, comprising:

a plurality of antenna modules each having a plurality of conductive elements, and being arranged in a plurality of adjacent disposed columns and rows to thereby form a grid arrangement, each said column including at least three of said antenna modules;

in each of said columns, a second one of said three antenna modules being orientated such that its said conductive elements are rotated 90° from said conductive elements of a first one of said three antenna modules; and in each of said columns, a third one of said three antenna modules being orientated such that its said conductive elements are rotated 90° from said conductive elements of said second one of said three antenna modules; and wherein each said antenna module in at least one said row is rotated 90° relative to its two immediately adjacent said antenna modules in a given said column.

9. The antenna system of claim 8, wherein said antenna system produces a maximum cross polarization isolation at azimuth scan angles of 0° and 60° relative to a boresight of said antenna system.

10. A method of forming a phased array antenna system, comprising the steps of:

disposing a plurality of independent antenna modules, each having a pair of conductive elements, in a plurality of generally parallel columns to form a grid comprised of rows and columns;

in each of said columns, arranging adjacent pairs of said antenna modules such that said conductive elements of each of said adjacent antenna modules pairs are rotated 90 degrees from one another.

* * * * *